United States Patent [19]

Baker et al.

[11] Patent Number: 4,840,415

[45] Date of Patent: Jun. 20, 1989

[54] APPARATUS TO MOVE NEGATIVES

[75] Inventors: Ralph E. Baker, Vancouver; Gordon G. Landherr, Surrey, both of Canada

[73] Assignee: Ampro Photo Workshops Limited, Vancouver, Canada

[21] Appl. No.: 161,729

[22] Filed: Feb. 29, 1988

[51] Int. Cl.[4] ..... B25B 27/00

[52] U.S. Cl. ..... 294/1.1

[58] Field of Search ..... 294/1.1, 19.1, 15, 33, 294/27.1; 16/114 R; 15/104 A; 220/94 R; 221/210; 81/488

[56] References Cited

U.S. PATENT DOCUMENTS 3,864,993 2/1975 Hovind ..... 294/1.1

3,912,321 10/1975 Williamson ..... 294/1.1

*Primary Examiner*—James B. Marbert

*Attorney, Agent, or Firm*—Fetherstonhaugh & Co.

[57] ABSTRACT

An apparatus for moving a longitudinal film strip carrying positive or negative images and having spaced perforations along parallel longitudinal edges of the strip in a longitudinal pocket, and comprising a longitudinal planar member having first and second parallel longitudinal edges and a plurality of spaced, flexible gripping members extending out of the plane of the longitudinal member. The gripping members engage in the spaced perforations along parallel edges of the film strip when the planar member is positioned adjacent the strip in an overlying manner within a longitudinal pocket holding the strip. In a preferred embodiment, the gripping members are triangular and are arranged in spaced parallel row adjacent the first and second edges.

4 Claims, 1 Drawing Sheet

APPARATUS TO MOVE NEGATIVES

FIELD OF THE INVENTION

This invention relates to a device to move a film strip carrying positive or negative images in and out of a storage compartment that holds the film strip.

BACKGROUND OF THE INVENTION

In photography, a camera is used to expose a light sensitive film to light in order to create an image on the film. With normal film, the film is processed to create a negative image of the original image, and by projecting the negative image onto light sensitive paper a photograph is produced. With slide film, the film is processed to produce a positive image.

Generally, the processed film with its positive or negative image is cut into discrete lengths or film strips. These strips are of celluloid material having spaced, generally rectangular, perforations down the two parallel longitudinal edges of the strip where the film was wound about the storage spool of a camera.

Film strips carrying positive or negative images are routinely stored and saved as they provide a source for making multiple copies of a photograph. Presently, the most common storage method is to place the film strips in longitudinal pockets formed from transparent plastic. This arrangement allows the images to be examined by holding them up to a light.

The longitudinal pockets tend to be very tight in order to securely and safely hold the film strips. Unfortunately, this makes inserting and removing the strips from the pockets a frustrating task. The strips should be handled by their edges in order to avoid damaging the images thereon, but removing the strips often involves inserting a finger into a pocket and pressing against the surface of the strip in order to "fish" the strip out of a pocket. When inserting the strip into a pocket, care must be taken to push smoothly and gently so that the strip does not jam and bend thereby damaging an image.

SUMMARY OF THE INVENTION

At present, there exists no tool to allow for the quick and easy manipulation of film strips carrying positive or negative images into and out of the storage pockets in common use today, and it is an object of the present invention to provide such an apparatus.

Accordingly, the present invention is an apparatus for moving a longitudinal film strip carrying positive or negative images having spaced perforations along parallel longitudinal edges of the strip in a longitudinal pocket, and comprising:

a longitudinal planar member having first and second parallel longitudinal edges and a plurality of spaced, flexible gripping means extending out of the plane of the longitudinal member for engagement in the spaced perforations along parallel edges of the film strip when said planar member is positioned adjacent a film strip in an overlying manner within a longitudinal pocket holding said film strip.

In a preferred embodiment, the gripping means are arranged in spaced parallel rows adjacent the first and second longitudinal edges of the planar member.

By inserting the negative moving apparatus of the present invention into a storage pocket and engaging the gripping means in the spaced perforations of the film strip, the apparatus can be used to slide the film strip into and out of the pocket without handling the strip with bare hands.

The negative moving apparatus of the present invention provides an efficient and reliable means for handling film strips and avoids the often frustrating task of manipulating the strips by hand.

BRIEF DESCRIPTION OF THE DRAWINGS

The negative moving apparatus of the present invention is shown in the following drawings in which.

DESCRIPTION OF THE PREFERRED EMBODIMENTS

Figure 1:
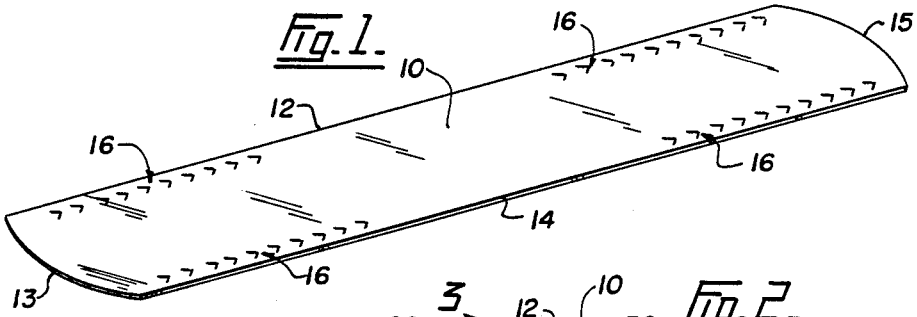
FIG. 1 is a pictorial view of a preferred embodiment of the apparatus.

Referring to FIG. 1, there is shown a pictorial view of a preferred embodiment of the present invention that comprises a longitudinal planar member 10 having parallel longitudinal side edges 12 and 14, and end edges 13 and 15. Member 10 is formed from thin cardboard, plastic or similar like material.

Figure 5:
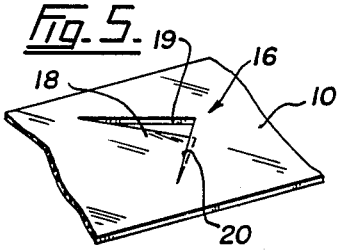
FIG. 5 is a detailed view of a triangular gripping means.

Adjacent side edges 12 and 14 of member 10 and running parallel thereto, a plurality of gripping means 16 are formed. In the preferred embodiment, each of these gripping means comprises a flexible triangular cut-out portion 18 that is bent out of the plane of member 10 as best shown in FIG. 5. The triangular cut-out portion 18 is formed by making two angled cuts 19 and 20 through the material of planar member 10 that intersect at apex 20. The triangular portion 18 is folded along an imaginary base line extending between the non-intersecting ends of lines 19 and 20 out of the plane of member 10. Alternatively, cut-out portion 18 may be formed with a rounded apex.

Returning to FIG. 1, it is shown that all gripping means 16 point in the same direction and would be bent such that they all extend out of the plane of member 10 in the same direction. While FIG. 1 shows the gripping means 16 extending only part way along the length of member 10 in two sections adjacent the end edges, it is understood that the gripping means may extend along the entire length of each side edge.

Figure 2:
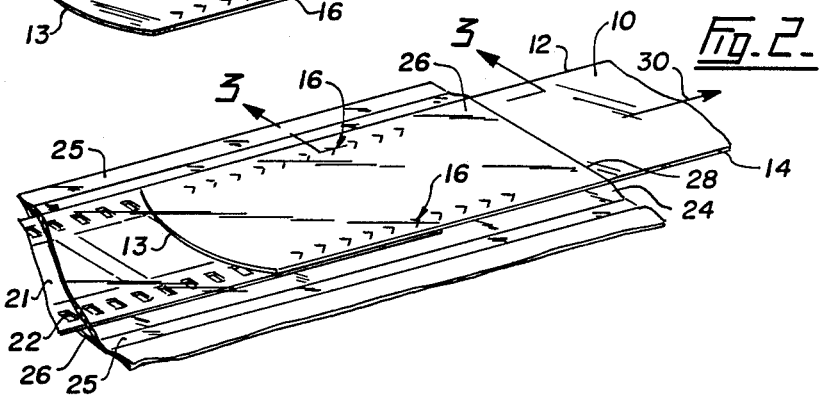
FIG. 2 is a pictorial view showing the preferred embodiment in use.

FIG. 2 shows the apparatus of the present invention in use. A film strip 21 having spaced perforations 22 extending longitudinally down the side edges of the strip is housed within a pocket 24 used for storing film strips. The pocket 24 comprises a longitudinal envelope formed by sealing upper and lower sheets 26 of a transparent plastic material together along parallel side seams 25 and a base seam (not shown). An end seam is not sealed to provide opening 28 which allows access to the pocket. Generally, a series of parallel pockets 24 would be formed across a sheet to provide multiple pockets for storing film strips.

Pocket 24 is dimensioned to accept film strip 21. In order to remove the strip, member 10 is inserted into the pocket overtop or underneath the strip such that triangular gripping means 16 engage the perforations 22 of the strip. In order to accomplish this task, it is necessary that gripping means 16 be spaced apart from each other essentially the same distance as the perforations 21, and the parallel rows of gripping means be spaced apart a distance essentially equal to the distance between the rows of perforations. Therefore, various embodiments of the present invention would have to be constructed to handle film strips with differently dimensioned perforations.

Figure 3:
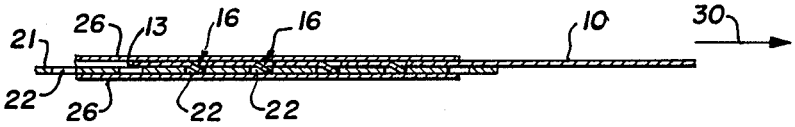
FIG. 3 is a sectioned view taken along line 3—3 of FIG. 2 showing the apparatus being used to remove a film strip from a storage pocket.

FIG. 3 shows how gripping means 16 engage in the perforations 22 of strip 21. In the illustrated embodiment, end edge 13 is inserted into pocket 24. When pushing the member 10 into the pocket 24, gripping means 16 will tend to flex upwardly into the plane of the member allowing for smooth and easy insertion. By pulling on the exposed end of member 10 in the direction of arrow 30, gripping means 16 will catch and hold in perforations 22 bending outwardly from the plane of member 10 so that strip 21 may be pulled from within pocket 24.

Figure 4:
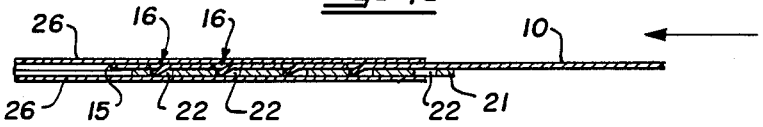
FIG. 4 is a sectioned view showing the apparatus being used to insert a film strip into a storage pocket.

In a similar manner, FIG. 4 shows how the apparatus of the present application can be used to push a film strip into a pocket 24 with gripping means 16 engaged in perforations 22. In this case, end edge 15 opposite end edge 13 is used. The apparatus ensures that the pushing force is evenly distributed over a surface of the film strip so that the tendency for the strip to snag and buckle is eliminated.

We claim:

1. An apparatus for moving a longitudinal film strip carrying positive or negative images having spaced perforations along parallel longitudinal edges of the strip in a longitudinal pocket comprising:

a longitudinal planar member having first and second parallel longitudinal edges and a plurality of spaced, flexible gripping means extending out of the plane of the longitudinal member for engagement in the spaced perforations along parallel edges of a film strip when said planar member is positioned adjacent a film strip in an overlying manner within a longitudinal pocket holding said film strip.

2. An apparatus as claimed in claim 1 in which said gripping means are arranged in spaced parallel rows adjacent said first and second parallel longitudinal edges.

3. An apparatus as claimed in claim 1 in which said gripping means comprises triangular members formed in the planar surface of said longitudinal member having an apex and a base edge, each triangular member being formed by cutting two intersecting lines in said planar member that meet at said apex and bending the triangular portion enclosed by said lines out of the plane of the device along a fold line that corresponds to the base edge of said triangular member.

4. An apparatus as claimed in claim 3 in which said apexes of said triangular members all face in the same direction and extend out of the plane of said planar member in the same direction.

* * * * *